United States Patent [19]

Feldstein

[11] 4,082,899

[45] Apr. 4, 1978

[54] METHOD OF APPLYING CATALYSTS FOR ELECTROLESS DEPOSITION AND ARTICLE

[76] Inventor: Nathan Feldstein, 63 Hemlock Cir., Princeton, N.J. 08540

[21] Appl. No.: 720,588

[22] Filed: Sep. 7, 1976

[51] Int. Cl.[2] ..... C23C 3/02

[52] U.S. Cl. ..... 428/457; 428/433; 428/463; 427/305; 427/306; 427/444; 106/1.11

[58] Field of Search ..... 427/306, 305, 304, 444; 106/1; 428/457, 463, 433

[56] References Cited

U.S. PATENT DOCUMENTS

| | | | |
|---|---|---|---|
| 3,011,920 | 12/1961 | Shipley | 252/472 |
| 3,093,509 | 6/1963 | Wein | 427/305 X |
| 3,119,709 | 1/1964 | Atkinson | 427/305 |
| 3,245,826 | 4/1966 | Luce et al. | 428/609 |
| 3,457,138 | 7/1969 | Miller | 427/305 X |
| 3,573,973 | 4/1971 | Drotar et al. | 427/304 |
| 3,666,527 | 5/1972 | Feldstein et al. | 427/306 |
| 3,672,923 | 6/1972 | Zeblisky | 427/304 |

OTHER PUBLICATIONS

Lowenheim, Modern Electroplating, 3rd Ed., 1974, pp. 645-646.

*Primary Examiner*—Ralph S. Kendall
*Attorney, Agent, or Firm*—Joel F. Spivak

[57] ABSTRACT

Catalytic compositions useful in the preparation of substrates prior to chemical deposition (autocatalytic plating) comprises an excess hydrolyzable stannic ion relative to stannous ions together with catalytic metal(s) and selected chemical additives. By simple adjustments, a plurality of substrates may be treated.

11 Claims, No Drawings

METHOD OF APPLYING CATALYSTS FOR ELECTROLESS DEPOSITION AND ARTICLE

BACKGROUND OF THE INVENTION

The present invention relates to electroless plating processes also known as chemical or autocatalytic plating. In particular this invention relates to compositions and methods of treating non-conductors to make them receptive to metallic deposition thereon.

Methods for the catalytic treatment of non-conductive (dielectrics) substrates to make them receptive to chemical plating are well known in the art as described in patents and technical publication. The following patents and articles are a few fully describing the state of the art and they are included within this application by reference U.S. Pat. Nos.

3,011,920; 3,672,923; 3,672,938; 2,421,079; 3,532,518; 3,961,109; 3,841,881; 3,904,792; 3,874,882; 2,303,871; 2,702,253; 3,093,509; 3,379,556; 3,425,946; 3,607,352; 3,616,296; 3,627,558; 3,664,860; 3,666,527; 3,674,550; 3,682,671; 3,698,919; 3,767,583; 3,871,889; 3,874,897; 3,902,908; 3,790,400.

Technical articles:

1. N. Feldstein et al, J. Electrochem. Soc., 119, 1486 (1972) and references therein are included.
2. R. L. Meek et al, proceeding of "Fifth Plating in the Electronics Industry Symposium," N.Y., Mar. 24, 1975.
3. G. A. Krulik, "The Catalytic Process in Electroless Plating," presented at the Am. Electroplaters Society, Denver, June 30, 1976.

Also, Pending Applications Ser. Nos. 607,506 now U.S. Pat. No. 3,993,799 and 521,901 now U.S. Pat. No. 3,993,491 by the present applicant.

Summarizing the prior art (patents and publications) reveals:

1. In all prior art the main emphasis was focussed upon combinations of tin(II) and palladium(II) used sequentially or in combination.
2. In all cases acid(s) have been used as an integral part of the composition.
3. In those cases in which tin(IV) was incorporated its concentration was significantly lower in comparison to the tin(II) concentration. In fact, many skilled in the art have tried to avoid its presence.
4. A wide variety of anti-oxidant have been incorporated as to minimize the air oxidation of the tin(II).
5. The so called "one step catalyst" after Shipley U.S. Pat. No. 3,011,920 and related patents were generally found ineffective when used on vitreous (glass, ceramic, oxides and the like) matter. It is noted that there are commercially available plastics which behave in a similar fashion to the vitreous matter.

SUMMARY OF THE INVENTION

A catalytic composition for electroless deposition comprises (a) sensitizers capable of sensitizing vitreous substrates without modification and non-vitreous substrates upon modification and (b) a catalytic metal.

It is intended that the novel composition include a composition derived from sequentially treating a substrate with sensitizer and then catalytic metal as well as a composition of sensitizer and catalytic metal coexisting prior to or after use on a substrate, both variations being included in the term "catalytic composition." The invention also includes modification of the above catalytic composition by inclusion of additives as hereinafter set forth.

DESCRIPTION OF PREFERRED EMBODIMENT

In the present invention it has been recognized that effective sensitizers, catalytic compositions and processes may be prepared through the admixing of hydrolyzable stannic and stannous ion wherein the former ion is in excess of the latter ion and to which thermal energy (also referred to as aging) has been supplied. This resulting admixture is used in direct combination with a catalytic metal or its use on a subtrate can be followed by treatment with such catalytic metal. In addition, the present composition lends itself adaptable to a variety of substrates; and thus the present catalysts may be considered as a universal plating catalyst overcoming a major limitation of the prior art catalysts.

The following terms are defined herein. These definitions are provided for the purpose of this invention and should not be confused with prior-art terminology.

The term "sensitizer" as used herein is intended to encompass compositions which comprise aged tin(IV) and tin(II) wherein the concentration tin(IV) is in excess to tin(II).

The term "modifier" as used herein is intended to encompass substances which alter the selectivity of the compositions as sensitizers for selected groups of substrates. For example, the sensitizer without modifier is useful for sensitization of vitreous materials while through the utilization of the modifier, successful sensitization for electroless deposition may take place on miscellaneous plastics (e.g., ABS) but may prevent the sensitization of the vitreous matter (e.g., glass, ceramic.) While I do not wish to be bound by theory it is believed that the "modifier" (e.g., soluble halide like NaCl) reacts with the aged tin(IV) insoluble matter in a manner resembling an anion exchange (or nucleophillic exchange). As a result of this exchange it is believed that the insoluble tin(IV) product becomes more negatively charged, resulting in modifications of its adsorption properties on the surface of the various substrates. It is noted that there are certain organic (polymers) products which behave in a similar fashion to the vitreous matter. For the sake of simplicity, for the purpose of this application, such organic products would be included within the general term of "vitreous matter."

The term "oxidation stabilizer" as used herein is intended to encompass substances which retards the chemical oxidation of a key chemical component present (i.e., tin(II)). Such materials are well known in the art and may be found readily in the above issued patents. However, since the present compositions rely upon a new chemistry it must be insured that the added "oxidation stabilizer" be compatible with the overall composition. One material of use as an oxidation stabilizer is tin metal.

The term "catalytic metal" as used herein is intended to encompass compounds of metal and metal ions wherein the metals are suitable catalysts for chemical (electroless) metal initiation. Such metals include precious and nonprecious metals and combinations thereof. Catalytic metals should be obvious to those skilled in the art from the above issued patents as well as the pending applications cited.

The term "colloid stabilizer" as used herein is intended to encompass substances which tend to prevent agglomeration and/or precipitation of a colloid. These materials are generally adsorbed on the surface of the colloid thereby altering the surface charge characteristics of the colloid. Typical colloid stabilizers include proteins, starches, sugars, alcohols and surfactants.

It is noted that at times a specific compound when added may function in more than one way. For instance, as may be noted from the examples, the incorporation of sodium chloride provides both change in substrate selectivity and some stabilization is expected.

It is further noted that wide variety of compounds may be introduced for any of several practical reasons. However, it should be noted that while a given component may be beneficial for a specific task, it must be assured that such component is compatible with all other components present. While it is possible to speculate which additive would be compatible, e.g., sodium iodide, it is probably best to determine its compatibility by substitution and evaluation.

The following examples illustrate the composition and method of utilization of the new catalytic compositions. The catalysts are prepared and evaluated within a plating process.

The evaluation consisted of the following key steps: Immersion of glass slides (or ceramic) and/or ABS into the sensitizer composition or catalytic composition for about 3 minutes at room temperature and water rinse, and the immersion into an alkaline electroless copper formulation while electroless copper was selected; other electroless plating composition, e.g., cobalt, nickel, etc., may be substituted.

EXAMPLE 1

A sensitizer composition comprising

| | |
|---|---|
| $SnCl_4$ | $1.4 \times 10^{-2}$M |
| $SnCl_2$ | $2.2 \times 10^{-3}$M |

was used. This solution was derived from a concentrated stock solution wherein the two salts were admixed and aged by heating. Alternatively, one may first age a tin(IV) solution and later add the tin(II) to it to obtain the desired concentration. Also, for example, after the aging of the tin(IV) one may add simultaneously the tin(II) together with the catalytic metal in an adduct in which the tin(II) and the catalytic metal (or compound of such) may have already reacted chemically.

Following the immersion into the sensitizer solution a brief immersion into a 0.5 g/l $PdCl_2$ in HCl was used. Plating evaluation with the aforementioned copper plating bath was noted to be good on glass; howver, poor on the ABS. (The Pd is the catalytic metal in this example.) It is also noted that a similar composition (sensitizer) in alkaline media did show significant activity.

EXAMPLE 2

NaCl (100 g/l) was added to the sensitizer solution of Example 1; all other steps remained the same. Results showed a reversal, i.e., good plating on ABS, and poor plating on glass. Calcium chloride was used as the replacement for sodium chloride.

EXAMPLE 3

A catalytic composition comprising of

| | |
|---|---|
| $SnCl_4$ | $1.4 \times 10^{-2}$M |
| $SnCl_2$ | $2.2 \times 10^{-3}$M |
| $PdCl_2$ | $4.5 \times 10^{-4}$M |

This solution was prepared by a dilution of a stock concentrate similar to the procedure of Example 1. A brief immersion of the substrate in 10% $HBF_4$ too place immediately prior to the plating step. While plating was noted on a ceramic piece (alumina), only a few spots were plated on the ABS substrate.

EXAMPLE 4

To the composition of Example 3, 100 g/l of NaCl was added. Results showed improvement of plating uniformity on ABS and deterioration of plating using glass and ceramic substrates.

EXAMPLE 5

The procedure of Example 1 was used except tht the following two solutions in the sequence shown were used in the place of the palladium solution.

1. A copper containing solution 6 g/l copper acetate·$H_2O$ and 1 minute immersion.
2. A dimethylamineborane (2½ g/l) and 1 minute immersion.

Using a glass slide as a substrate resulted in good plating uniformity. It was also found that the above steps 1 and 2 could be replaced by 1[1]. 6 g/l Ni Acetate·$4H_2O$ 2[2]. 0.5 g/l $NaBH_4$ for about 3 minutes.

Using a glass slide clearly showed perceptible plating. In addition, replacing the above nickel solution with 4 g/l $MnCl_2 \cdot 4H_2O$ showed some plating although to a lesser degree in comparison to the nickel solution.

In view of thse results it should be obvious to one skilled in the art that the applicant's teachings incorporated in S.N. 521,901 now U.S. Pat. No. 3,993,491 are thus incorporated herein and using such teaching with the new compositions (together or sequentially) would thus fall within the spirit of this invention.

EXAMPLE 6

A composition as in Example 1 was prepared; however, incorporated was a cationic surfactant (FC-134 product of 3M) at a concentration of about 0.04 g/l in the sensitizer formulation. The incorporation of this cationic surfactant seemed to improve the stability of the sensitizer composition. Based upon this experiment it should be obvious to those skilled in the art that a variety of other cationic surfactants as well as amphoretic surfactants may be useful in place of the FC-134.

EXAMPLE 7

Amphoteric surfactant Zonyl FSB(product of duPont) was incorporated in the concentrate composition used in Example 1 providing a concentration of 0.2 ml/l. This produce (Zonyl FSB) is 40% solid in isopropanol water dilutant mixture.

EXAMPLE 8

Using the procedure of Example 1, a UV exposure (using a Mercury pen light) through a mask was interposed after immersing a glass substrate in the sensitizer composition (10 × conc. of No. 1). Results (after plating) showed a clear pattern generated replicating the mask pattern.

While I do not wish to be bound by theory the following remarks are provided to facilitate further insight of the phenomenon. In the present compositions it is believed that upon the aging of an hydrolyzable tin(IV) a colloidal dispersion results as noted in FIG. 5 of J. Electrochem. Soc., 119, p. 1489 (1972). However, in the presence of tin(II) (or radicals comprised of tin(II)), a reaction complex is formed which has been designated as a "homonuclear intervalence-transfer system" according to E. C. Allen et al, "Progress in Inorganic Chemistry," F. A. Colton, editor, Chapter 8, p. 357, Interscience Publishers, New York 1967. As part of the tin(II) radical or reaction complex, catalytic metal ions may be bound in bonding orbitals.

I have generally found that the resulting sensitizer compositions are improved in stability as tin(IV) is increased relative to tin(II). For example, holding the Sn(II) at $2.2 \times 10^{-2}$M the tin(IV) was varied between $1.4 \times 10^{-2}$M to $7.0 \times 10^{-2}$M. Relatively stable compositions (without a noticeable cloudy appearance) were observed for those compositions in which the tin(IV) was approximately $3.5 \times 10^{-2}$M and above or at least about 1.5 times the tin(II) concentration.

It is further noted that the concentrations given (in the examples), while they reflect the actual amount added, in practice one would expect the tin(II) concentration to be slightly lower (due to air oxidation) and hence the tin(IV) would be higher. In addition I have recognized that due to the spontaneous nature by which the aged tin(IV) reacts with tin(II) in forming the reaction complex, the tin(II) is thus stabilized against air oxidation.

Applicant considers his invention as set forth herein to be broader than any of the specific examples used for teaching the invention and contemplates a scope such as enables those skilled in the art to substitute or add various compounds or compositions to the novel compositions herein utilizing available prior art.

What I claim is:

1. A method for preparing a substrate prior to electroless (chemical) metal deposition comprising the step of treating said substrate with a catalytic composition comprising a sensitizer and a catalytic metal and wherein said sensitizer comprises aged tin(IV) and tin(II) and wherein said tin(IV) in said aged tin(IV) is in excess relative to tin(II).

2. The method recited in claim 1 wherein said catalytic composition is applied to said substrate by sequentially treating said substrate with a sensitizer composition and then with a composition containing a catalytic metal and wherein said sensitizer composition comprises aged tin(IV) and tin(II) and wherein said tin(IV) in said aged tin(IV) is in excess relative to tin(II).

3. The method recited in claim 1 wherein said catalytic composition is a composition comprising both the sensitizer and catalytic metal and wherein said sensitizer composition comprises aged tin(IV) and tin(II) and wherein said tin(IV) in said aged tin(IV) Is in excess relative to tin(II).

4. The method according to claim 3 wherein the sensitizer composition further includes a oxidation stabilizer.

5. The method recited in claim 1 wherein said sensitizer further contains a modifier selected from the group consisting of soluble chlorides and bromides.

6. The method recited in claim 1 wherein said catalytic composition further includes a oxidation stabilizer.

7. The method according to claim 1 wherein said sensitizer comprises aged tin(IV) and tin(II) and wherein said tin(IV) in said aged tin(IV) is in a relative ratio to tin(II) of at least about 1.5 to 1.0.

8. A metal plated non-conductor substrate formed by the steps comprising (a) treating said substrate with a catalytic composition comprising a sensitizer and a catalytic metal wherein said sensitizer comprises aged tin(IV) and tin(II) and wherein said tin(IV) in said aged tin(IV) is in excess relative to tin(II), and (b) treating above treated substrate with a suitable electroless (chemical) plating composition.

9. The metal plated substrate recited in claim 8 wherein said plating composition is an electroless nickel.

10. The metal plated substrate recited in claim 8 wherein said sensitizer comprises aged tin(IV) and tin(II) in a relative ratio of at least about 1.5 to 1.0.

11. The metal plated substrate recited in claim 8 wherein the sensitizer further includes a oxidation stabilizer.

* * * * *